US006776621B1

(12) United States Patent
Dye

(10) Patent No.: US 6,776,621 B1
(45) Date of Patent: Aug. 17, 2004

(54) BOARD MOUNTED COAX CONNECTOR ASSEMBLY

(75) Inventor: David Eugene Dye, Rancho Santa Margarita, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/651,269

(22) Filed: Aug. 27, 2003

(51) Int. Cl.[7] ..... H01R 12/00
(52) U.S. Cl. ..... 439/63
(58) Field of Search ..... 439/63, 579, 581

(56) References Cited

U.S. PATENT DOCUMENTS 5,215,470 A * 6/1993 Henry et al. ..... 439/63
5,851,121 A 12/1998 Thenaisie et al. ..... 439/63
6,045,402 A 4/2000 Embo et al. ..... 439/579
6,132,244 A 10/2000 Leeman et al. ..... 439/541.5
6,164,977 A 12/2000 Lester ..... 439/63
6,305,947 B1 10/2001 Bruce ..... 439/63
6,319,016 B1 11/2001 Juntwait ..... 439/63
6,341,961 B1 1/2002 Juntwait ..... 439/63
6,358,062 B1 3/2002 Feldman et al. ..... 439/63
6,679,728 B1 * 1/2004 Huang et al. ..... 439/579
2002/0164901 A1 * 11/2002 Annequin ..... 439/579

* cited by examiner

*Primary Examiner*—Lynn Feild
*Assistant Examiner*—Phuong Dinh
(74) *Attorney, Agent, or Firm*—Roger C. Turner

(57) ABSTRACT

A coaxial connector assembly (10) for mounting on a circuit board, which can be constructed at low cost and which provides low losses. The connector assembly, which can include three connectors (11, 12, 13), includes a cast metal housing (40) having a front mating end (20) and having a rear end (22) that terminates to a circuit board (80). Each connector includes a combination (60) of a center conductor (62) with a horizontally-extending front portion (70) and a downwardly-extending rear portion (74), and an insulator (64) that surrounds the inner conductor. The housing is a metal cast member with its front portion forming two concentric sleeves (100, 102) at each connector (11–13), the inside (44) of the inner sleeve forming the front portion of a through passage (42) whose rear portion extends downwardly. The combination of center conductor and insulation is installed by pressing it forwardly into the housing passage. Then, a metal retainer (140) is forced upwardly into the rear of the housing passage to lock the combination center conductor and insulator in place and to provide a ground around the rear of the center conductor.

12 Claims, 2 Drawing Sheets

BOARD MOUNTED COAX CONNECTOR ASSEMBLY

BACKGROUND OF THE INVENTION

One type of coaxial connector has a rear end that is mounted on a circuit board and a front end that is spaced from the circuit board and that can mate to another coaxial connector. Many connectors of this type have a cast metal housing forming two or three coax connectors with passages each having a right angle bend. Each such connector has an outer coax contact in the form of a sleeve that is press fit or otherwise fit into the cast housing, and a combination of center conductor and insulation that surrounds it which are also fitted into the housing, within the outer conductor sleeve. The manufacture and insulation of the several components results in additional cost. A coaxial connector of minimal cost and ease of assembly, which provided low losses, would be of value.

SUMMARY OF THE INVENTION

In accordance with one embodiment of the present invention, a coaxial connector assembly with coax connectors is provided for mounting on a circuit board, which can be constructed at low cost while providing low losses. The connector assembly includes a cast metal housing with a rear portion for mounting on an upper face of a circuit board, and a front portion that opens horizontally to a mating connector device. The mating front portion of the cast housing is formed with integral inner and outer sleeves for each connector, the inner sleeve forming the front portion and smallest diameter portion of a through passage that extends to the rear and to the bottom of the rear of the housing.

A combination of center conductor and insulation can be inserted forwardly into each passage, until forwardly-facing shoulders on the insulation abut rearwardly-facing shoulders on the housing. A retainer is then forced upwardly into the rear of the passage. The retainer is formed of metal, and its front end lies closely adjacent to the rear of the vertically-extending insulation to complete a grounded surface around the vertically-extending portion of the center contact.

DESCRIPTION OF THE PREFERRED EMBODIMENT

Figure 1:
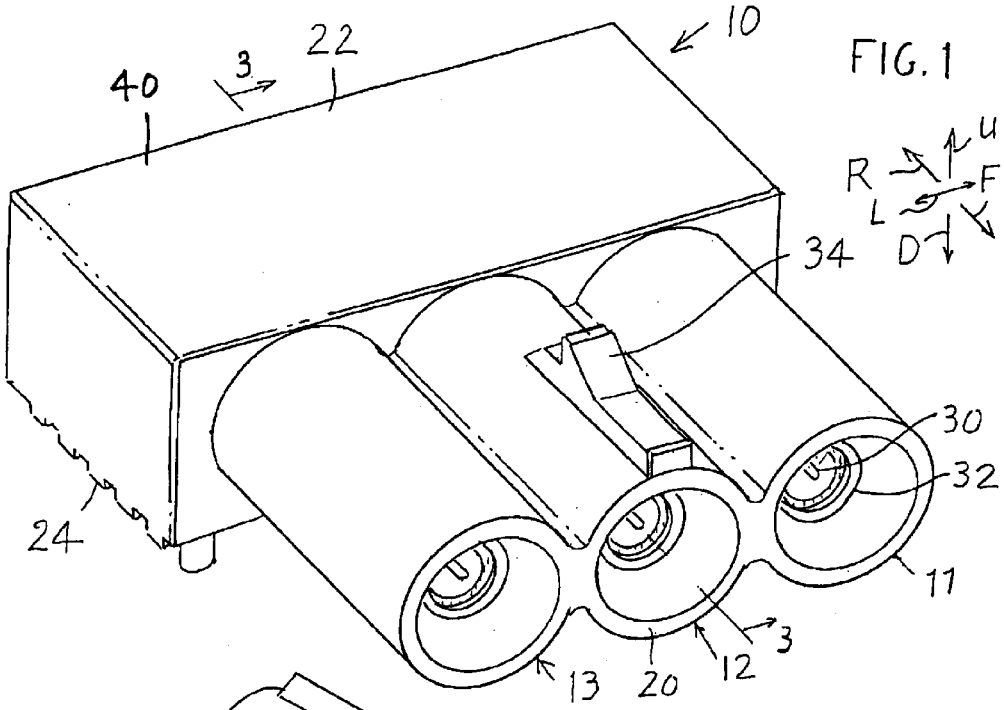
FIG. 1 is a front and top isometric view of a coax connector of the present invention.

FIG. 1 illustrates a 3-way connector assembly 10 which includes a metal housing 40 forming part of three coaxial connectors 11–13. The three coaxial connectors are of the same constructions except that one of them 12 lies laterally L between the other two. Accordingly, the description of one of them 12 applies to the other coaxial connectors.

The connector 12 has front and rear connector ends 20, 22 that are spaced in front F and rear R directions. The rear connector end 22 has a bottom 24 for mounting on a circuit board. Each connector has largely coaxial inner and outer contacts 30, 32. The connector assembly 10 has a standard 3-way design which includes a latch 34 for latching to a mating coax device.

Figure 3:
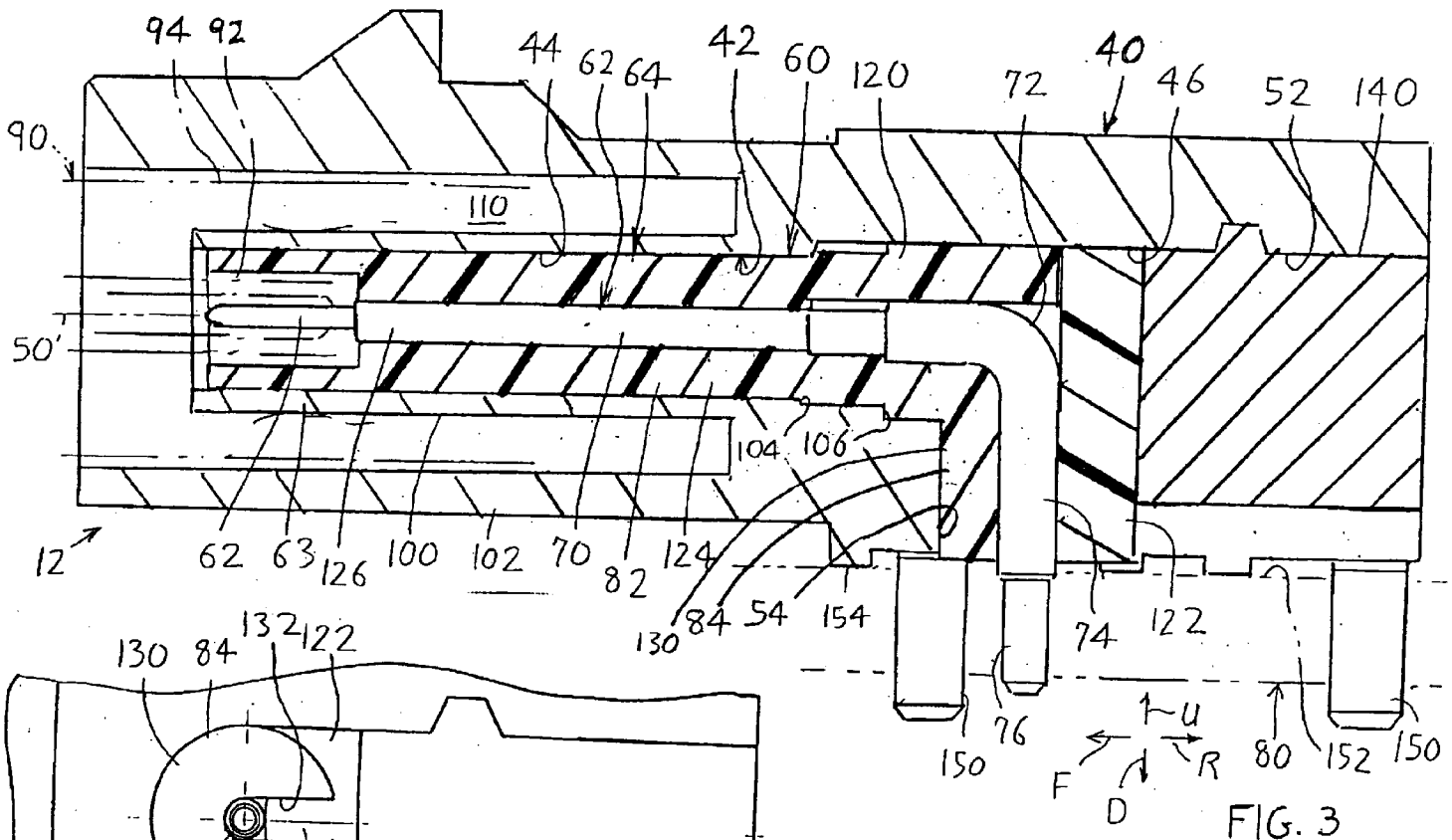
FIG. 3 is a sectional view taken on line 3—3 of FIG. 1, and showing the connector mounted on a circuit board, the circuit board being shown in phantom lines.

FIG. 3 shows that the metal housing 40 has a through passage 42 with front and rear passage ends 44, 46. The passage extends along an axis 50 through the entire length of the connector housing. The passage rear end has rearwardly 52 and downwardly 54 extending passage portions. A combination 60 of a center conductor 62 and insulation 64 lies in the housing passage 42.

The inner or center contact 62 of the coaxial connector has a horizontally-elongated part 70 with a rear, has a right angle bend 72 at the rear, and has a vertically-elongated part 74 extending downwardly D, with a pin-shaped lower end 76 projecting into a plated hole in a circuit board 80 on which the connector is mounted. The insulation 64 of the combination includes a horizontal insulation portion 82 that surrounds the center contact along its horizontally-elongated part 70 and a vertical insulation portion 84 that surrounds the vertical part 74 of the center contact.

A mating connector device indicated at 90, has inner and outer coax terminals 92, 94 which make contact with inner and outer contacts 62, 63 of the connector.

The metal housing 40 of the connector is a cast metal part. The housing front portion is formed with inner and outer sleeves 100, 102 that make contact with the terminals 92, 94 of the mating connector device 90. Applicant forms the metal housing as a cast metal part in which the inner and outer sleeves 100, 102 are integrally cast. The front passage end 44 formed by the inside of the sleeve 100 has the smallest width along the passage, and the rear passage end 46 has larger widths to form shoulders 104, 106. This allows the housing to be cast using a casting core that forms the reception space 110 between the inner and outer sleeves, the core being inserted rearwardly R into position, while another core that forms the passage 42 is inserted forwardly F into position.

Figure 4:
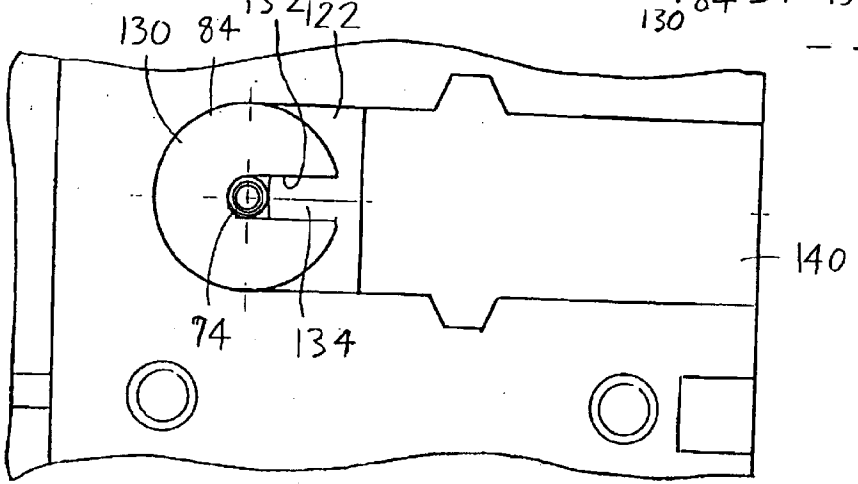
FIG. 4 is a bottom view of a portion of the connector of FIG. 2.

The insulation 64 has two parts, including a main insulation part, or element 120 and a second or secondary insulation part, or element 122. The main insulation part 120 includes the horizontally-extending tubular front region or part 82 that forms a passageway 83 that surrounds the mating front end of the inner contact, and a vertically-extending tubular rear region 130 that forms much of the vertically-extending insulation part 84. As shown in the bottom view of FIG. 4, the tubular rear region 130 has a slot 132 that allows it to be slipped around the inner contact rear part 74. The second insulation part 122 has a projection 134 that projects into the slot to fill it, and provides insulation around the entire inner contact vertical portion 74.

It would be possible to provide a one-piece insulation around the inner contact, as by overmolding the inner contact. However, this increases the cost of the part. Applicant's use of two insulation parts that each can be injection molded in large numbers, reduces the cost of the connector.

Figure 2:
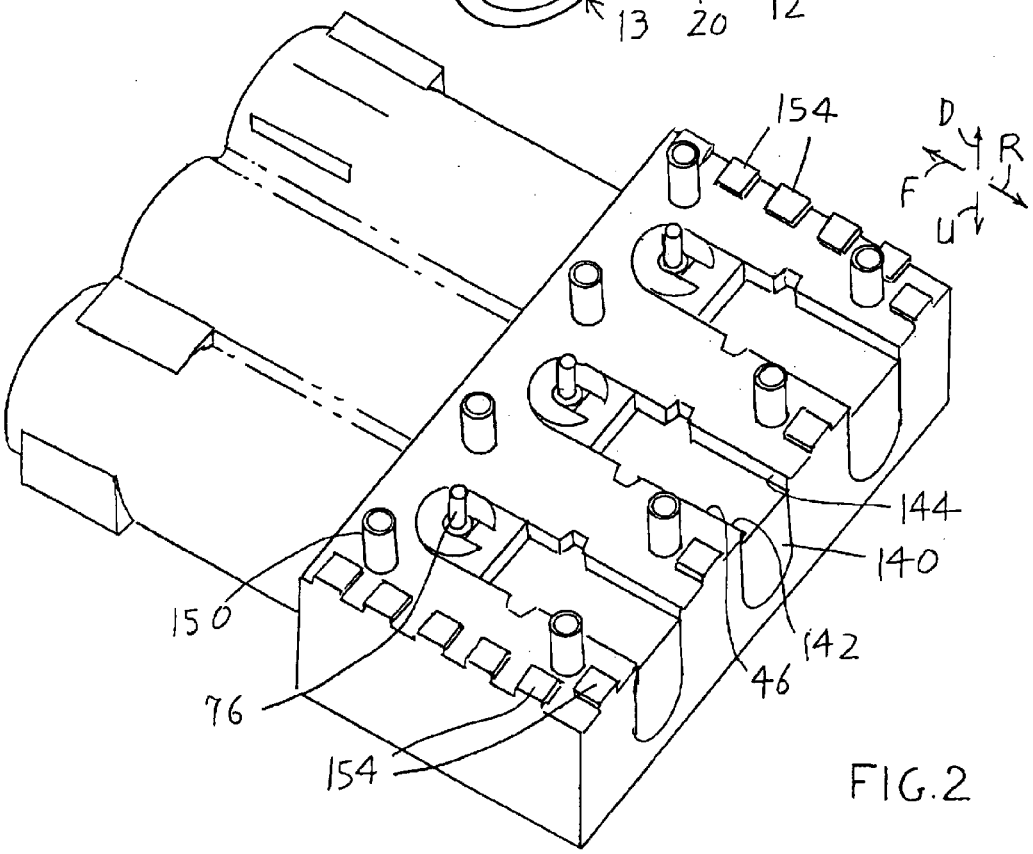
FIG. 2 is a bottom and rear isometric view of the connector of FIG. 1.

FIG. 3 shows that the rear passage end 46 is plugged by a retainer 140. The retainer 140 is preferably of metal, to surround the vertical parts 74 of the inner contact with metal. This retains largely a constant characteristic impedance of a coax connector, to minimize losses. To assemble the connector, the combination 60 of inner contact and insulation is inserted forwardly F into the passage 42 in a loose fit. The retainer 140 is preferably inserted upwardly U into the passage, in an interference fit. As shown in FIG. 2, the rear passage end 46 has opposite walls 142, 144 that can be spread apart slightly. This facilitates upward insertion of the retainer 140 into the passage rear end, and the obtaining of a tight press fit without excessive insertion force. The use of the retainer 140 (FIG. 3) enables the combination 60 of inner contact and insulation to be retained without requiring that the combination be very tightly press fit into the passage.

When the connector assembly 10 has been assembled, it can be mounted on the top or upper face 152 of the circuit board 80 by pressing down housing posts 150 into corresponding plated-through holes in the circuit board which are electrically grounded. Such downward force presses vertical pin end 76 of each of the three coaxial connectors into corresponding plated holes in the circuit board. A solder paste usually has been provided for soldering the post and pins in place. Standoffs 154 space much of the housing from the circuit board, and allow conductive traces to lie under the housing.

The provision of a plurality of coaxial connectors in a single connector assembly, increases the robustness of the assembly and decreases cost. The larger lateral L width results in more stable mounting on the circuit board, with the standoffs at laterally opposite sides serving for all connectors. A retainer of greater than average lateral width is offset by a retainer of average or smaller than average width. A single cast housing provides two concentric sleeves for a plurality of connectors in a single casting, and assures that all sleeves are reliably connected together and to a ground trace on a circuit board.

While terms such as "horizontally," "top," "bottom," etc., have been used to help describe the invention as it is illustrated in the drawings, it should be understood that the circuit board and coaxial connector mounted thereon, can be used in any orientation with respect to the Earth.

Thus, the invention provides a coaxial connector assembly that includes a plurality of coaxial connectors, of the type that have mounted ends that mount on a circuit board and mating ends that extend perpendicular to the mounted ends and that are adapted to mate to mating coax devices. The coax connector assembly has a cast metal housing with its mating portions forming concentric inner and outer sleeves formed in a single casting, the inner sleeve forming the narrowest and frontmost portion of a passage that extends to the rear and to the bottom of the rear of the connector. A combination of inner contact and insulation includes a main insulation portion that forms the insulation part that surrounds the horizontal mating portion of the contact and that forms much of the vertical portion of the inner contact. A second insulation part extends into a slot of the main insulation part to enable the insulation to be molded in two parts that are assembled around the inner contact. A retainer lies in the rear of each passage, and is preferably of metal to provide an outer contact portion that lies closely around the entire vertical part of the inner contact. The retainer is preferably press fit into the rear passage part, with the rear passage part having opposite walls that can spring slightly apart and together.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A coaxial connector assembly for mounting on an upper face of a circuit board, said connector assembly including a plurality of connectors that each has horizontally-spaced front and rear connector ends, each front connector end forming a mating end for mating to a coax device, each rear connector end having a lower part for mounting on said circuit board, each connector having inner and outer coax contacts and an insulation between them, at least said inner coax contact of each connector having a horizontally-extending first mating end at the connector front end and a right angle bend and a downwardly-extending mount end that extends downwardly from said bend to said board, each connector including a metal housing portion forming at least a portion of said outer contact, including:

a single metal housing forming said metal housing portions of said connectors, said housing having a mating end that forms inner and outer sleeve parts in each connector, each outer sleeve part having a primarily cylindrical inside first surface and each inner sleeve part having a primarily cylindrical outside second surface that is concentric with the first surface, the first and second surfaces being spaced to receive a portion of the mating coax device between them;

said housing is a cast metal part, and said inner and outer sleeve parts of all of said connectors are integrally cast.

2. The connector assembly described in claim 1 wherein:

said housing has a plurality of largely horizontally-extending through passages, each inner sleeve having an inside forming a front part of the corresponding through passage and having a predetermined width, each through passage having a greater width rearward of the passage front part than along the passage rear part.

3. The connector assembly described in claim 1 wherein:

the insulation of each connector includes a horizontally-extending tubular front insulation region that surrounds the inner contact first mating end, and a vertically-extending tubular rear insulation region that surrounds said inner contact downwardly-extending mount end; and including a plurality of metal rear retainers that each lies immediately rearward of the vertically-extending tubular rear insulation region of one of said connectors.

4. The connector assembly described in claim 3 wherein:

the insulation of each of said connectors includes a one-piece main insulation member that forms said horizontally-extending tubular front insulation region and a front part of said vertically-extending tubular rear insulation region, each insulation also including a one-piece second insulation member that forms a rear of the vertically-extending tubular portion.

5. The connector assembly described in claim 4 wherein:

said front of said vertically-extending tubular rear region of each of said main insulation members forms a sleeve that encircles the downwardly-extending inner contact end except for a slot at the rear of the sleeve, and each second insulation member has a forward projection that projects into the slot.

6. A coaxial connector assembly for mounting on an upper face of a circuit board, comprising:

a housing having a plurality of horizontal through passages that each have front and rear passage ends, each passage rear end having a rearwardly-opening and downwardly opening passage portion;

a combination of a center conductor and an insulation for each of said passages;

each of said center contacts has a horizontally-elongated part with a rear, a right angle bend at said rear, and a vertical part extending downward from said bend;

the insulation of each of said combinations includes a horizontal insulation portion that surrounds the corresponding center contact horizontally-elongated part and a vertical insulation portion that surrounds the center contact vertical part;

said housing is formed of metal and forms integral inner and outer sleeves with closest surfaces that are concentric at the front end of each passage, each of, said inner sleeves having concentric inner and outer surfaces, the inner surface of each inner sleeve forming a front portion of the corresponding horizontal through passage, and each combination center conductor and insulation being insertable forwardly into one of said through passages, each center contact vertical part and vertical insulation portion being insertable forwardly into a corresponding downwardly opening passage portion.

7. The connector assembly described in claim 6 including:

a plurality of metal retainers that each lies in a rear end of one of said housing through passages and that lies adjacent to a rear of a corresponding one of said vertical insulation portions.

8. The connector assembly described in claim 6 including:

a plurality of metal retainers that each lies in a press fit in the rear end of one of said through passages, each press fit made by pressing a retainer upwardly into the rear end of one of the through passages.

9. The connector assembly described in claim 6 wherein:

each of said insulations includes main and secondary insulation elements, the main insulation element including one of said horizontal insulation portions and a front of one of said vertical insulation portions, and the secondary insulation element forming part of a rear of one of said vertical insulation portions.

10. The connector assembly described in claim 9 wherein:

said vertical insulation portion has a slot for passing said center contact vertical part, and said secondary insulation element has a projection that projects into said slot.

11. A method for forming a plurality of coaxial connectors with parallel horizontal axes, with front mating ends facing along a corresponding one of said axes for mating to a coax device, and with rear board-mounts for mounting on an upper face of a circuit board, comprising:

casting a housing with a plurality of pairs of integral sleeves, each pair of sleeves including an outer sleeve having a cylindrical inside surface and an inner sleeve having cylindrical inner and outer surfaces concentric with the corresponding outer sleeve inside surface and with one of said horizontal axes, including forming a plurality of horizontal through passages in said housing with each passage extending along one of said axes and with each passage being narrowest along the corresponding cylindrical inner surface of the front mating end and forming at least one forwardly-facing shoulder rearward of the cylindrical inner surface of the inner sleeve;

inserting a combination of an inner contact that has a right angle bend and an insulation that surrounds said inner contact, forwardly into each of said horizontal through passages;

inserting a metal retainer upwardly into a rear end of each of said through passages to lie immediately rearward of the corresponding insulation.

12. The method described in claim 10 wherein:

said step of inserting each of said combinations includes inserting a horizontal portion of the corresponding inner contact forwardly into a horizontal passageway of a main insulation element of one of said insulations, and passing a vertical portion of the inner contact through a slot in a vertically-extending passage of the main insulation element, and then inserting a forward projection of a second insulation element into the slot.

* * * * *